US006837385B2

(12) United States Patent
Bennett et al.

(10) Patent No.: US 6,837,385 B2
(45) Date of Patent: Jan. 4, 2005

(54) APPARATUS FOR SUPPORTING ARTICLES ON AN EASEL

(75) Inventors: James E. Bennett, Westport, CT (US); Jonathan Sonneborn, Easton, CT (US)

(73) Assignee: Really Good Stuff, Inc., Monroe, CT (US)

( * ) Notice: Subject to any disclaimer, the term of this patent is extended or adjusted under 35 U.S.C. 154(b) by 0 days.

(21) Appl. No.: 10/236,569

(22) Filed: Sep. 6, 2002

(65) Prior Publication Data

US 2003/0150828 A1 Aug. 14, 2003

Related U.S. Application Data

(60) Provisional application No. 60/355,098, filed on Feb. 8, 2002.

(51) Int. Cl.[7] ..... A47F 5/08

(52) U.S. Cl. ..... 211/118; 211/198; 211/85.29

(58) Field of Search ..... 211/69.1, 118, 211/113, 117, 198, 85.2, 71.01, 85.29; 206/6.1, 301, 372, 566, 1.7–1.9, 286, 284, 289, 290, 291; 248/441.1

(56) References Cited

U.S. PATENT DOCUMENTS

| | | | | | |
|---|---|---|---|---|---|
| 1,094,009 | A | * | 4/1914 | Parkhurst | 206/373 |
| 2,016,421 | A | * | 10/1935 | Eichner | 211/70.6 |
| 3,083,835 | A | * | 4/1963 | Coralline | 211/118 |
| 3,355,030 | A | * | 11/1967 | Cathcart | 211/88.04 |
| 3,389,945 | A | * | 6/1968 | Thomas | 312/231 |
| 3,967,666 | A | * | 7/1976 | Farrar | 383/7 |
| 4,223,783 | A | * | 9/1980 | Marshall | 206/495 |
| 4,335,812 | A | * | 6/1982 | Koves | 206/1.8 |
| 4,401,219 | A | * | 8/1983 | Mink | 206/566 |
| 4,574,990 | A | | 3/1986 | Remis | |
| 4,595,106 | A | * | 6/1986 | Kunze et al. | 211/118 |
| 4,662,517 | A | * | 5/1987 | Wirth | 206/388 |
| 4,735,246 | A | * | 4/1988 | Niehaus | 206/6.1 |
| 4,773,535 | A | * | 9/1988 | Cook | 206/373 |
| 4,809,892 | A | | 3/1989 | Chinski et al. | |
| 4,846,430 | A | * | 7/1989 | Ke | 248/215 |
| 4,958,727 | A | * | 9/1990 | Bergeron | 206/6.1 |
| 4,986,427 | A | * | 1/1991 | Law et al. | 211/64 |
| 5,027,960 | A | * | 7/1991 | Rainville | 211/118 |
| 5,121,833 | A | * | 6/1992 | Lindsay et al. | 206/6.1 |
| 5,209,344 | A | * | 5/1993 | Smith | 206/6.1 |
| 5,350,071 | A | * | 9/1994 | Pond | 211/70.6 |
| 5,363,953 | A | * | 11/1994 | Carter | 206/6.1 |
| 5,427,230 | A | * | 6/1995 | Mattox | 206/6.1 |
| 5,542,530 | A | * | 8/1996 | Freelander | 206/292 |
| 5,779,033 | A | * | 7/1998 | Roegner | 206/6.1 |
| 5,890,587 | A | * | 4/1999 | Roegner | 206/6.1 |
| 6,206,183 | B1 | | 3/2001 | Helsel | |
| 2002/0190017 | A1 | * | 12/2002 | Stevens | 211/118 |

* cited by examiner

*Primary Examiner*—Carl D. Friedman
*Assistant Examiner*—Jennifer E. Novosad
(74) *Attorney, Agent, or Firm*—McCarter & English, LLP

(57) ABSTRACT

An apparatus for storing art gear on a media support structure having a working surface, such as an easel, in a position adjacent the working surface to maintain the art gear in close proximity to the work in progress.

11 Claims, 3 Drawing Sheets

APPARATUS FOR SUPPORTING ARTICLES ON AN EASEL

CROSS-REFERENCE TO RELATED APPLICATION

The subject application claims the benefit of priority to commonly owned, co-pending U.S. Provisional Application Ser. No. 60/355,098, filed Feb. 8, 2002, the disclosure of which is herein incorporated by reference in its entirety.

BACKGROUND OF THE INVENTION

1. Field of the Invention

The subject disclosure relates generally to an apparatus for supporting and storing articles conveniently, and more particularly, to an apparatus for supporting and storing art gear such as markers, paint brushes, crayons, paints, paper, or other items on an easel.

2. Background of the Related Art

There is immense educational, recreational and even therapeutic value in encouraging and engaging in artistic endeavors. For such reasons, programs which provide avenues for artistic expression are commonplace in institutions, such as schools, community centers, adult-care facilities, after-school programs and daycare facilities.

Creating artwork typically requires various materials, such as pencils, pens, paint brushes, markers, and related implements (hereinafter collectively referred to as "art gear"), and media for the application of such implements, such as paper, canvas or posterboard. A support structure is typically used for securing the media, preferably in a position for the artist to work comfortably, and for thereafter displaying a finished work product. The most inexpensive and commonly used support structure for such purposes is an easel.

However, keeping track of the art gear has historically been a difficult task. The implements are often used with varying regularity depending on the particular art project. For such reasons, as well as others, specifically if children are involved, the art gear may be easily displaced.

When the use of an easel involves travel, such as artistic pursuits conducted in the great outdoors, transporting the gear to a desirable outdoor location is a difficult task. In particular, for those desiring to employ artistic mediums requiring the use of an easel, carrying the easel and other required tools and supplies may be cumbersome and often impossible, requiring multiple trips to transport all of the gear.

Consequently, a need exists for an apparatus capable of storing the various art gear and implements necessary for artistic pursuits or otherwise. Furthermore, it would be advantageous to have an apparatus configured for attachment to the media support structure to maintain the art gear in close proximity to the work in progress for the convenience of the artist.

SUMMARY OF THE INVENTION

The present disclosure provides an apparatus for storing art gear and various artistic implements which may be attached to a media support structure, such as an easel, to maintain the art gear in close proximity to the work in progress.

In particular, the present disclosure provides an apparatus for supporting articles on an easel having a support frame and an elevated working surface. This apparatus includes a support member having opposed upper and lower edges and opposed front and rear surfaces, means associated with the front surface for supporting art gear in a position adjacent the elevated working surface and means associated with the upper and lower edges of the support member for maintaining the support member adjacent to the elevated working surface.

Preferably, the support member is substantially planar and made of a plastic material. The means for supporting the art gear may include at least one compartment disposed on the front surface of the support member. The means for maintaining the support member adjacent to the elevated working surface is preferably accomplished by a support system, which may include one or more straps for securing the support member to the easel and one or more elongated rods for contacting the easel support frame. Preferably, the rods are associated with the upper and lower edges of the support member and also help provide structure for the support member.

In addition, the size of the above apparatus may be adjusted by, among other things, corresponding non-permanent engagements or releasable fasteners positioned adjacent the upper and lower edges on the rear surface. Preferably, the fasteners serve to reduce or increase the surface area of the front surface.

The present disclosure also embodies an apparatus including a substantially planar support member having opposed upper and lower edges and opposed front and rear surfaces, at least one compartment disposed on the front surface of the support member for supporting art gear in a position adjacent the elevated working surface, and means associated with the support member for maintaining the support member adjacent to the elevated working surface.

In one aspect of the aforementioned apparatus, the means associated with the support member for maintaining the support member includes one or more elongated rods for contacting the easel support frame and at least one adjustable strap for securing the support member to the easel.

In another aspect of the aforementioned apparatus, the means associated with the support member for maintaining the support member includes an upper elongated rod associated with the upper edge of the support member for contacting the easel support frame, a lower elongated rod associated with the lower edge of the support member for contacting the easel support frame, and at least one adjustable strap associated with the upper edge of the support member for securing the support member to the easel.

In yet another aspect, the aforementioned apparatus includes a non-permanent means for reducing the size of the support member, which preferably, is accomplished by a releasable fastener, such as for example, corresponding snap-fit devices disposed adjacent to the upper and lower edges on the rear surface of the support member. It is preferable that an apparatus constructed in accordance with this aspect of the present disclosure include a dividing elongated rod positioned between the upper and lower edges on the rear surface of the support member.

These and other unique features of the apparatus constructed in accordance with the subject disclosure will become more readily apparent from the following description of the drawings taken in conjunction with the detailed description of the exemplary and presently preferred embodiments.

BRIEF DESCRIPTION OF THE FIGURES

So that those having ordinary skill in the art to which the present disclosure pertains will more readily understand how to make and use the apparatus of the present disclosure, embodiments thereof will be described in detail hereinbelow with reference to the accompanying figures, wherein.

These and other features of the apparatus constructed in accordance with the present disclosure will become more readily apparent to those having ordinary skill in the art from the following detailed description of the exemplary and presently preferred embodiments.

DETAILED DESCRIPTION OF THE DISCLOSURE

Easels are illustrated and discussed hereafter for purposes of illustrating and describing the advantageous features of an apparatus constructed in accordance with the present disclosure. However, the exemplary apparatus may fully function as advantageously with any media support structure of common construction, that is, having a frame for supporting an elevated working surface, or with other structures used in situations where there exists a need for supporting articles for use in an adjacent position to a working area.

Figure 1:
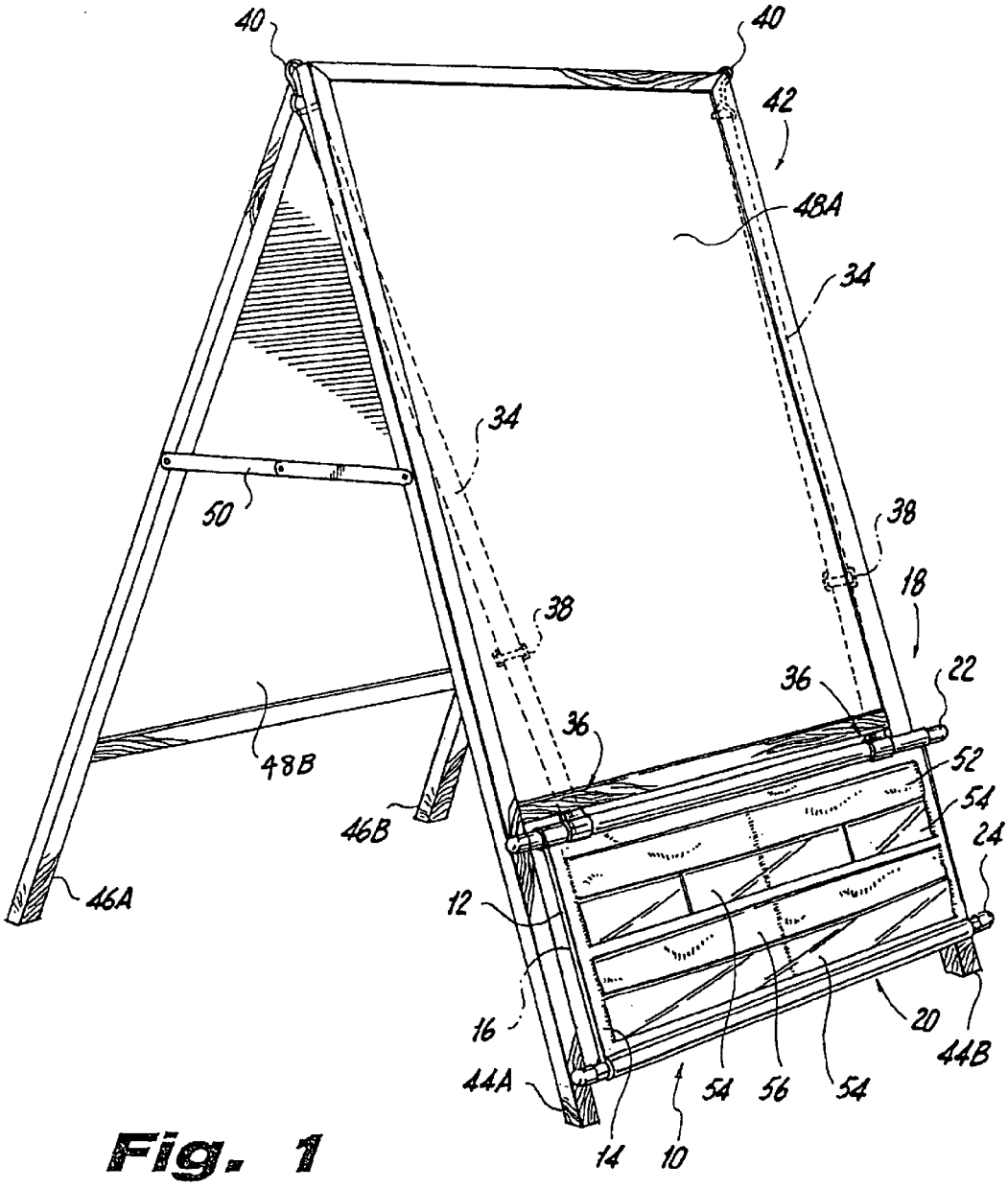
FIG. 1 is a perspective view of an easel which includes a suspended apparatus fabricated in accordance with a preferred embodiment of the present disclosure shown in a first orientation.
Figure 2:
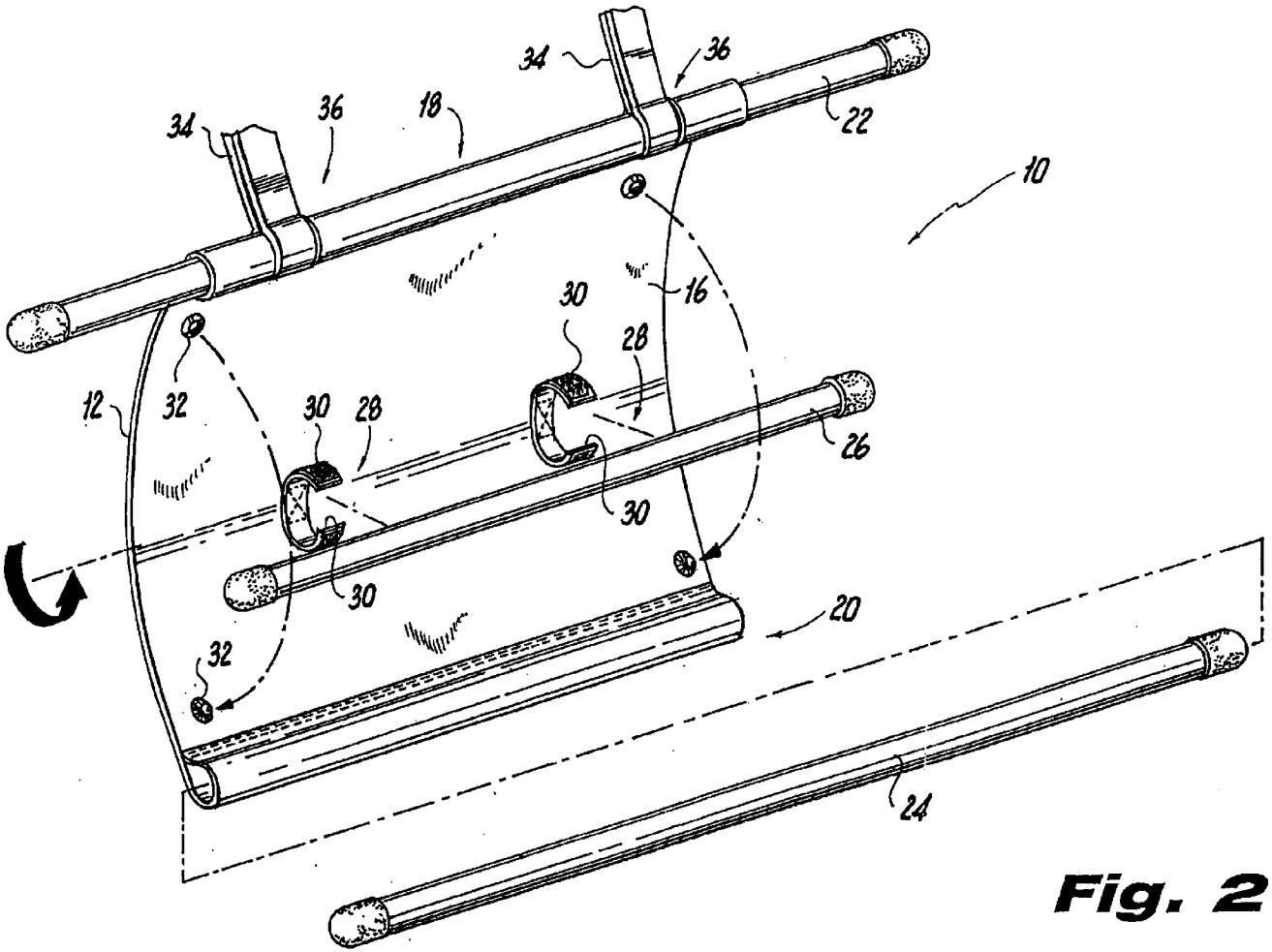
FIG. 2 is a plan view of the rear surface of the inventive apparatus shown in FIG. 1.

FIGS. 1 and 2 illustrate an apparatus constructed in accordance with the present disclosure generally designated by the reference character 10. Apparatus 10 has a suspended carrier body 12 defining a front surface 14, a rear surface 16, and opposed upper and lower ends 18 and 20, respectively. Preferably, suspended body 12 is substantially planar, rectangular and fabricated of a durable and resilient material, such as nylon or canvas. Suspended body 12 may also consist of more than one layer of material.

Two ribs, hereinafter referred to as upper stabilizer rod 22 and lower stabilizer rod 24, are associated with the suspended body 12 to provide structural support to the suspended body 12, among other things. An upper stabilizer rod 22 is attached to suspended body 12 at a location adjacent to upper end 18. A lower stabilizer rod 24 is attached to suspended body 12 at a location adjacent lower end 20. Preferably, upper and lower stabilizer rods 22 and 24 are permanently attached to suspended body 12 and substantially parallel with respect to each other. The longitudinal length of stabilizer rods 22 and 24 may either be substantially the same or differ, but preferably, stabilizer rods 22 and 24 are substantially cylindrical and fabricated of a lightweight, rigid material such as a plastic or aluminum with rubberized-caps disposed at each end. Alternatively, the rods may be rectangular or have one or more planar sides. In this embodiment, upper and lower stabilizer rods 22 and 24 are attached to suspended body 12 via a portion of the material used to fabricate suspended body 12 at the upper and lower ends 18 and 20 being sewn over a portion of the upper and lower stabilizer rods 22 and 24, thus forming a sleeve. Alternatively, multiple loops of material may be used.

In the embodiment illustrated in FIG. 2, a dividing stabilizer rod 26 is attached to the rear surface 16 of suspended body 12. Preferably, dividing stabilizer rod 26 is positioned between, and substantially parallel with, the upper and lower stabilizer rods 22 and 24, respectively. In this embodiment, upper and lower stabilizer rods 22 and 24 are longer in longitudinal length than dividing stabilizer rod 26, and thus extend farther from suspended body 12 when compared with dividing stabilizer rod 26. Alternatively, dividing stabilizer rod 26 may be longer than upper and lower stabilizer rods 22 and 24, respectively. The portions, if any, of stabilizer rods 22, 24, and 26 that extend from suspended body 12 can be used to support articles. For example, aprons and paint brushes having apertures in the handles may be disposed on the stabilizer rods 22, 24 or 26. Preferably, dividing stabilizer rod 26 is removable and attached to the rear surface 16 via a removable fastening means. In this embodiment, material strips 28 are partially sewn onto rear surface 16 so that opposing ends 30 having corresponding hook and loop type fastener portions thereon are free to wrap around and secure dividing stabilizer rod 26.

Figure 3:
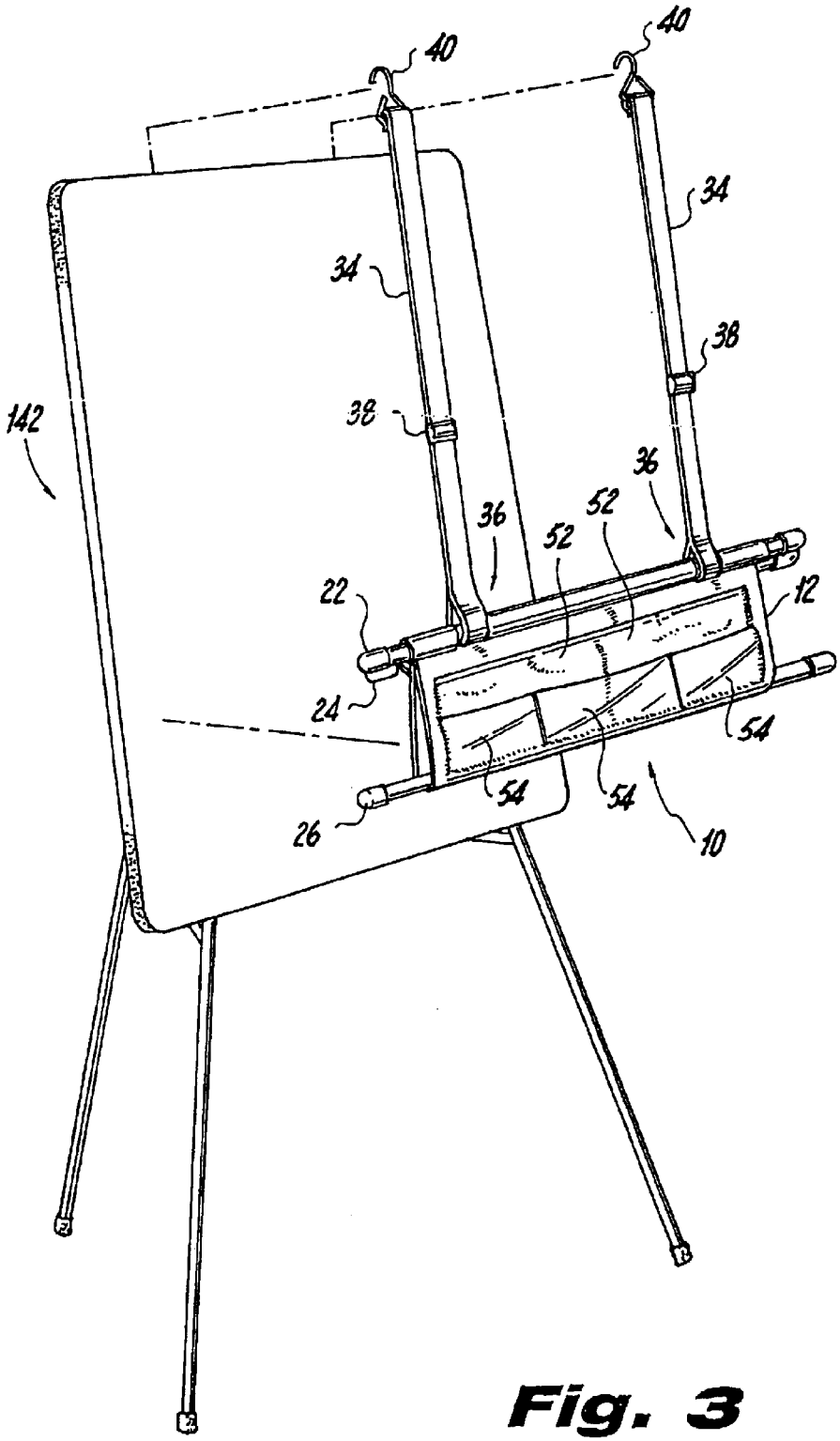
FIG. 3 is a perspective view of an easel which includes the suspended apparatus of FIG. 1 fabricated in accordance with the present disclosure shown in a second orientation.

Two sets of corresponding "snap" fittings 32 are disposed on rear surface 16 adjacent the upper and lower ends 18 and 20, respectively, to permit suspended body 12 to be folded over dividing stabilizer rod 26 and secured so that upper and lower ends 18 and 20 are essentially in the same plane. Alternatively, suspended body 12 may be compacted using other fastening methods, such as for example, hook and loop portions, buttons or ties. The "folded" configuration, as shown in FIG. 3, permits apparatus 10 to be substantially reduced in size without affecting functionality, say for example, where the space adjacent to a working space is limited.

Support straps 34 are associated with suspended body 12 for securing the apparatus. Preferably, support straps 34 are fabricated from a durable material, such as canvas or plastic. Portions of the suspended body 12 at upper end 18 are removed at locations 36 exposing the upper stabilizer rod 22. Support straps 34 are affixed to upper stabilizer rod 22 at locations 36. In this embodiment, a portion of each support strap 34 is wrapped around the upper stabilizer rod 22 and sewn together for a secure engagement. Alternatively, other fastening means may be utilized, such as a corresponding hook and loop type fastening assembly. A sliding strap length adjustment buckle 38 is disposed on each strap 34 and a hook 40 is attached to the other end of each support strap 34. Buckle 38 and hook 40 assist in providing for the accommodation and (non-permanent) attachment of apparatus 10 to easels of various sizes.

FIG. 1 illustrates the attachment of apparatus 10 to an easel 42 of common construction and size. Easel 42 essentially consists of an assembly of two frames, wherein each frame includes a set of legs, front legs 44A, 44B and rear legs 46A, 46B, and two elevated working surfaces 48A and mounted thereon. The frames are pivotably connected at one end by hinges (not shown) and have crossbars 50 (only one shown) which connect opposing front legs 44A, 44B and rear legs 46A, 46B from each frame to stabilize the assembly. Working surfaces 48A, 48B are generally planar backboards which may include transparent surfaces, erasable drawing surfaces, chalkboards, corkboards, magnetically attractive surfaces, etc. Working surfaces 48A, 48B are generally positioned at an angle with respect to the ground surface, in such a manner that the upper end of the working surface 48A, 48B would be farther than its lower end from someone standing in front of the working surface 48A, 48B. If working surfaces 48A, 48B are secured to the easel's legs, the angle generally corresponds to the angle of its associated legs 44A, 44B and 46A, 46B, respectively. Although apparatus 10 is illustrated in conjunction with easel 42, apparatus 10 may function as advantageously with other types of easels, such as for example, easels consisting of a tripod formed by three legs and a planar backboard which is mounted on two of the three legs.

A plurality of compartments or pockets 52 of various sizes may be disposed on front surface 14. Preferably, each pocket 52 is attached to front surface 14 along its right and left sides and lower end, thus creating an inner volume with the upper side of pocket 52 providing the sole opening into the inner volume. It is also preferable that pockets 52 be fabricated from a durable material, such as canvas and clear or opaque plastic, which may be sewn onto front surface 14. The left, right and/or lower ends of pockets 52 may also be pleated permitting the inner volume to be greater expandability. Also, as shown, apparatus 10 may incorporate outer pockets 54 sewn over larger inner pockets 56. Alternatively, front surface 14 may include bands, hooks, ties, or other structure for supporting articles thereon.

In use with an easel, such as easel 42 or 142, apparatus 10 is positioned adjacent a working surface 48A or 48B. As shown, the ends of upper and lower stabilizer rods 22 and 24 contact support legs 44A, 44B, which, among other things, inhibits movement of apparatus 10 in a direction parallel to the ground surface (i.e., horizontal), that may occur due to gravity and the angle of legs 44A, 44B with respect to the ground surface. Hooks 40 are attached to the upper end of working surface 48A, thus preventing apparatus 10 from falling downward. Support straps 34 may be placed between working surfaces 48A, 48B. This arrangement places front surface 14 in a position directly adjacent to the working surface 48A. Thus, pockets 52 (and implements therein) are made easily accessible relative to a position for the artist to work comfortably while using working surface 48A. As is readily apparent from FIG. 3, pockets 52 remain upright (although opposed) if apparatus 10 is used in its folded configuration, that is, with suspended body 12 being folded over dividing stabilizer rod 26 and secured to itself via snap fittings 32.

The subject disclosure provides an apparatus for supporting articles on an easel, particularly adapted to store useful implements in a convenient position adjacent to the working location. Although the preferred and exemplary embodiments of the present disclosure have been described with a full set of features, it is to be understood that the disclosed apparatus may function successfully without the incorporation of each of those features. It is to be further understood that modifications and variations may be utilized without departure from the spirit and scope of this inventive apparatus, as those skilled in the art will readily understand. Such modifications and variations are considered to be within the purview and scope of the appended claims and their equivalents.

What is claimed is:

1. In combination:

(a) an easel that includes first and second frames and at least one elevated working surface supported with respect to said first frame; and (b) an apparatus for supporting articles on said easel that includes;

(i) a substantially planar support member having opposed upper and lower edges and opposed front and rear surfaces;

(ii) at least one compartment disposed on the front surface of the support member for supporting art gear in a position adjacent the elevated working surface;

(iii) means mounted with respect to the support member and dimensioned to engage the first frame for maintaining the support member adjacent to the elevated working surface;

wherein said means for maintaining the support member includes an adjustable member that facilitates adjustable positioning of said support member relative to said first frame and wherein said means for maintaining the support member engages the first frame of said easel, thereby maintaining said support member adjacent to the elevated working surface.

2. A combination as recited in claim 1, further comprising corresponding snap-fit devices disposed on the rear surface of the support member of said apparatus, wherein the engagement of the snap-fit devices substantially reduces the size of the support member.

3. A combination as recited in claim 2, further comprising at least one elongated rod mounted with respect to the rear surface of the support member between the corresponding snap-fit devices.

4. A combination as recited in claim 1, wherein the means mounted with respect to the support member for maintaining the support member of said apparatus comprises one or more elongated rods for contacting the first frame and at least one adjustable strap for securing the support member to the easel.

5. A combination as recited in claim 1, wherein the means mounted with respect to the support member for maintaining the support member comprises:

(a) an upper elongated rod mounted with respect to the upper edge of the support member for contacting the first frame of the easel;

(b) a lower elongated rod mounted with respect to the lower edge of the support member for contacting the first frame of the easel; and, (c) at least one adjustable strap mounted with respect to the upper edge of the support member for securing the support member to the easel.

6. A combination as recited in claim 5, further comprising a dividing elongated rod associated with the rear surface of the support member and positioned between the upper and lower edges.

7. A combination as recited in claim 6, wherein the dividing elongated rod is substantially longer than the upper and lower elongated rods.

8. A combination as recited in claim 1, wherein the support member is made of nylon.

9. In combination:

(a) an easel that includes first and second frames and at least one elevated working surface supported with respect to said first frame; and (b) an apparatus for supporting articles on the easel, the apparatus including:

(i) a substantially planar support member having opposed upper and lower edges and opposed front and rear surfaces;

(ii) at least one compartment disposed on the front surface of the support member for supporting art gear in a position adjacent the elevated working surface;

(iii) first and second rods mounted with respect to the support member at the upper and lower edges of the support member, the first and second rods being dimensioned to maintain the support member adjacent to the elevated working surface by engaging the first frame of the easel; and (iv) at least one adjustable strap mounted with respect to the upper edge of the support member for securing the support member to the easel such that the upper edge of the support member is adjacent to the elevated working surface.

10. The combination of claim 9, wherein the apparatus for supporting articles further comprises means disposed adjacent the upper and lower edges for securing the support member in a folded configuration with the upper and lower edges substantially in the same plane.

11. The combination of claim 10, wherein the means for securing the support member in a folded configuration includes corresponding snap-fit devices disposed on the rear surface of the support member.

* * * * *